US010751965B2

(12) United States Patent
Fransson et al.

(10) Patent No.: US 10,751,965 B2
(45) Date of Patent: Aug. 25, 2020

(54) DEVICE AND METHOD FOR ATTACHMENT OF AN OPENING DEVICE ON A FLEXIBLE PACKAGE

(71) Applicant: Ecolean AB, Helsingborg (SE)

(72) Inventors: Jonas Fransson, Helsingborg (SE); Lars Rodman, Bjärred (SE)

(73) Assignee: ECOLEAN AB (SE)

( * ) Notice: Subject to any disclaimer, the term of this patent is extended or adjusted under 35 U.S.C. 154(b) by 585 days.

(21) Appl. No.: 15/030,053

(22) PCT Filed: Oct. 22, 2014

(86) PCT No.: PCT/EP2014/072662
§ 371 (c)(1),
(2) Date: Apr. 16, 2016

(87) PCT Pub. No.: WO2015/067469
PCT Pub. Date: May 14, 2015

(65) Prior Publication Data

US 2016/0250817 A1 Sep. 1, 2016

(30) Foreign Application Priority Data

Nov. 7, 2013 (EP) ..... 13191856

(51) Int. Cl.
*B31B 50/81* (2017.01)
*B31B 50/00* (2017.01)
(Continued)

(52) U.S. Cl.
CPC ..... *B31B 50/81* (2017.08); *B31B 50/00* (2017.08); *B31B 70/62* (2017.08); *B31B 70/64* (2017.08); *B31B 70/813* (2017.08)

(58) Field of Classification Search
CPC ..... B31B 1/90; B31B 50/00; B31B 50/81; B31B 70/64; B31B 70/813; B31B 70/62
(Continued)

(56) References Cited

U.S. PATENT DOCUMENTS 4,655,862 A * 4/1987 Christoff ..... B29C 65/20 156/244.11
4,909,870 A * 3/1990 Gould ..... A44B 19/16 156/178
(Continued)

FOREIGN PATENT DOCUMENTS

EP 2371527 A1 10/2011
JP H098581 A 1/1997
(Continued)

*Primary Examiner* — Chelsea E Stinson
*Assistant Examiner* — Mary C Hibbert-Copeland
(74) *Attorney, Agent, or Firm* — Condo Roccia Koptiw LLP

(57) ABSTRACT

A device and a method for attaching a resealable opening device (2) on a package (1), the device comprising an attachment unit (100) having at least one carrier member (101) being movable between a pick-up position and an attachment position, in which latter the carrier member (101) is arranged for attachment of the opening device on the package by means of relative movement between the carrier member and the package. The device further comprises an abutment (113) and a knife arrangement (112), wherein the at least one carrier member, in said pick-up position, is arranged for relative movement towards the abutment for engagement with a web (12) of interconnected opening devices arranged therebetween and for pick-up of one opening device; and wherein the knife arrangement is arranged to cooperate with the carrier member and the abutment or cutting out the opening device during the engagement of the carrier member with the web.

17 Claims, 13 Drawing Sheets

(51) Int. Cl.
*B31B 70/62* (2017.01)
*B31B 70/81* (2017.01)
*B31B 70/64* (2017.01)

(58) Field of Classification Search
USPC .... 493/213, 927, 212, 214; 383/5, 203, 204, 383/63, 65; 156/66, 178, 320
See application file for complete search history.

(56) References Cited

U.S. PATENT DOCUMENTS

| | | | | |
|---|---|---|---|---|
| 6,098,369 | A | 8/2000 | Bodolay et al. | |
| 6,620,087 | B1 | 9/2003 | Plourde | |
| 6,889,483 | B2 | 5/2005 | Compton et al. | |
| 6,994,470 | B2 | 2/2006 | Galomb | |
| 7,731,645 | B2 | 6/2010 | Gustavsson et al. | |
| 2004/0032995 | A1* | 2/2004 | Galomb | B29C 65/58 383/63 |
| 2010/0061666 | A1* | 3/2010 | Sprehe | B29C 69/006 383/204 |

FOREIGN PATENT DOCUMENTS

| | | | |
|---|---|---|---|
| JP | 2001 179852 | A | 7/2001 |
| JP | 2004131183 | A | 4/2004 |
| JP | 2004 142285 | A | 5/2004 |
| JP | 2006 007630 | A | 1/2006 |
| JP | 4536434 | B2 | 6/2010 |
| WO | WO 2012/062806 | | 5/2012 |
| WO | WO 2012/062806 | A1 | 5/2012 |

* cited by examiner

DEVICE AND METHOD FOR ATTACHMENT OF AN OPENING DEVICE ON A FLEXIBLE PACKAGE

CROSS REFERENCE TO RELATED APPLICATIONS

This application is the National Stage Entry under 35 U.S.C. § 371 of Patent Cooperation Treaty Application No. PCT/EP2014/072662, filed Oct. 22, 2014, which claims the benefit of European Patent Application No. 13191856.7, filed Nov. 7, 2013, the contents of which are hereby incorporated by reference herein.

FIELD OF THE INVENTION

The present invention relates to a device and a method for attaching a resealable opening device on a flexible package.

BACKGROUND ART

There are a large number of different goods which are packed in flexible containers or packages produced from a film material.

The packages may house particulate goods, such as crisps, peanuts or coffee beans, and in this case often have a so-called pillow shape.

Alternatively, the packages may house liquid goods, such as milk, water or wine, and are here normally of the so-called stand-up pouch type, also referred to as collapsible-type packages. Packages of the stand-up pouch type may, of course, also be used for particulate goods.

Packages or containers of this flexible type are normally opened by the removal of an end tab or corner portion. Alternatively, they can be opened by a user pulling apart the side walls of the package in order thereby to break an upper transverse seal of the package.

Common to these flexible packages is that there is often a need to be able to reseal the package once it has been opened. By resealing the package, the risk of accidental spillage of the content of the package is reduced, whilst the resealing often has a positive effect on the shelf life of the content.

This resealing can be realized with the aid of clips, screw caps, rubber bands, tapes, etc. It has nevertheless proved difficult to provide an opening device which is cheap, reliable and user-friendly.

A recently suggested opening device addressing these issues is known from WO21012/062806. The opening device disclosed therein comprises a thin-walled body which is to be attached on one side wall of a flexible package, in an opening portion thereof. The thin-walled body comprises a first hinge joint about which the body may be folded in order to open the package. A second hinge joint extending transverse to said first hinge is provided, and by folding about this second hinge, the package may be resealed. The body further comprises locking means for releasable locking of the body when folded about said second hinge.

U.S. Pat. No. 6,994,470 discloses an apparatus for attaching a snap closure on a package. The apparatus comprises a cutter for cutting lengths of closure strips and carrier heads for receiving the lengths of closure strips as well as for attaching the strips on opposing sidewalls of the package.

SUMMARY OF THE INVENTION

In view of the above, it is an object of the present invention to provide a device and a method for attaching a resealable opening device on a flexible package.

It is also an object of the invention to provide such a device and method for attaching a resealable opening device in the form of a thin-walled body on a flexible package.

According to the present invention, a device having the distinguishing features defined in claim 1 and a method having the distinguishing features of claim 13 are thus provided. Embodiments emerge from the sub-claims dependent on the respective main claims.

More precisely, according to the present invention, a device for attaching a resealable opening device on a flexible package is provided, which device comprises an attachment unit having at least one movably arranged carrier member, the at least one carrier member being movable between a pick-up position and an attachment position. The at least one carrier member is, in said attachment position, arranged for attachment of the opening device on an application area of the flexible package by means of relative movement between the carrier member and the flexible package. The device further comprises an abutment and a knife arrangement, wherein the at least one carrier member, in said pick-up position, is arranged for relative movement towards the abutment for engagement with a web of semi-finished and interconnected opening devices arranged therebetween and for pick-up of the opening device. The knife arrangement is arranged for cooperation with the carrier member and the abutment for cutting out the opening device during the engagement of the carrier member with the web.

An improved device for attachment of a resealable opening device on a flexible package is hereby provided.

The inventive device is arranged to cut out and pick up the opening device from a web made up of semi-finished and interconnected opening devices, and such a web is suitable for opening devices in the form of thin-walled bodies.

The cutting out and picking up of the opening device by means the cooperation between the carrier member, the abutment and the knife arrangement during the engagement of the carrier member with the web ensures a controlled and well-defined handling of the opening devices, both prior and after the opening has been picked up.

According to an embodiment of the present invention, the at least one carrier member may be, in said pick-up position, arranged to form the opening device by punch engagement with the web of semi-finished and interconnected opening devices. A punch engagement ensures a speedy and reliable forming of the opening device which forming may be repeated many times.

According to another embodiment of the present invention, the attachment unit may be rotatably arranged and wherein the at least one carrier member may be movable between said pick-up position and said attachment position by means of rotation of the attachment unit. Hereby the carrier member may be efficiently moved between the pick-up position and the attachment position.

According to yet another embodiment of the present invention, the device may further comprise a first heating unit provided at a heating position, wherein the at least one carrier member may arranged to pass the heating position during movement from said pick-up position to said attachment position, the first heating unit being arranged for activation of an adhesive layer of the opening device by heating. The opening device supported by the carrier member may thus be indexed on its way from the pick-up position to the attachment position and thereby pass a heating unit arranged to activate the adhesive layer of the opening device. The inventive device may thus be fed with opening devices having a non-sticky application surface, the adhesive layer being activated, i.e. sticky, only just prior to the attachment to the flexible package.

The first heating unit may comprise a heating plate arranged for activation of said adhesive layer by means of contact heating. Hereby a controlled heat transfer from the heating unit to the adhesive layer may be achieved.

The heating plate may have a profiled engagement surface. A profiled engagement surface, such as an undulated or wave-shaped surface, may be used to reshape a originally planar adhesive layer to a correspondingly profiled adhesive layer when activated through engagement with the engagement surface of said heating plate. The profiled and activated adhesive may have an improved capacity to accumulate heat transferred thereto and thus to remain in its activated state for a prolonged time.

According to yet another embodiment of the present invention, the device may further comprise a second heating unit for preheating of the application area of the flexible package. By preheating of said application area, a difference in temperature between the adhesive layer and the application area may be reduced. The reduced difference in temperature may improve the attachment of the opening device on the package. The second heating unit may be arranged for preheating of the application area by means of radiation.

According to yet another embodiment of the present invention, the at least one carrier member may comprise a carrier surface provided with a recess arranged for reception of a protrusion of the opening device. The carrier member may be provided with a retention means for holding the picked-up opening device. The retention device may comprise a pin movably arranged in said recess between an first position and a second position in which it lockingly engages the protrusion received into the recess.

According to another aspect of the invention, a method for attaching an opening device on a flexible package is provided. The method comprises providing a web of semi-finished and interconnected opening devices, forming and picking up an opening device by bringing a carrier member of an attachment unit to engagement with the web of semi-finished and interconnected opening devices, and attaching the opening device on an application area of the flexible package.

Hereby an improved method for attaching opening devices on flexible packages is provided. The opening device may be of the thin-walled type. The forming and picking up of the opening device by means of engagement of the carrier member with the web ensures a controlled and well-defined handling of the opening devices, both prior and after the opening has been picked up.

According to an embodiment of the present invention, the opening device may be formed by a punching engagement.

According to another embodiment, the method may further comprise activation of an adhesive layer of the opening device by contact heating prior to the attaching of the opening device. The activation of the adhesive layer may comprise engaging said adhesive layer with a profiled engagement surface.

According to yet another embodiment, the method may further comprise preheating of said application area prior to the attaching of the opening device.

The advantages which have been specified above with reference to the inventive device are in relevant parts also applicable to the inventive method Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of said element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DESCRIPTION OF EMBODIMENTS

The present invention relates to a device and a method for attaching a resealable opening device on a flexible package.

By a flexible package is meant a package or container which is made of a flexible material in the sense that the material is pliable. A flexible package of this kind may thus be made of a single-layered or multi-layered film material. The film material may comprise layers of plastic, such as PE, PP, PET, EVOH, and/or aluminium foil. Layers of plastic such as PE or PP may also comprise a filler, such as a mineral material.

By a resealable opening device is meant a device enabling resealing and subsequent reopening of a flexible package once it has been initially opened.

The invention is especially suitable for an opening device in the form of a thin-walled body which is to be attached to a side wall of a flexible package in an opening portion thereof.

Figure 1:
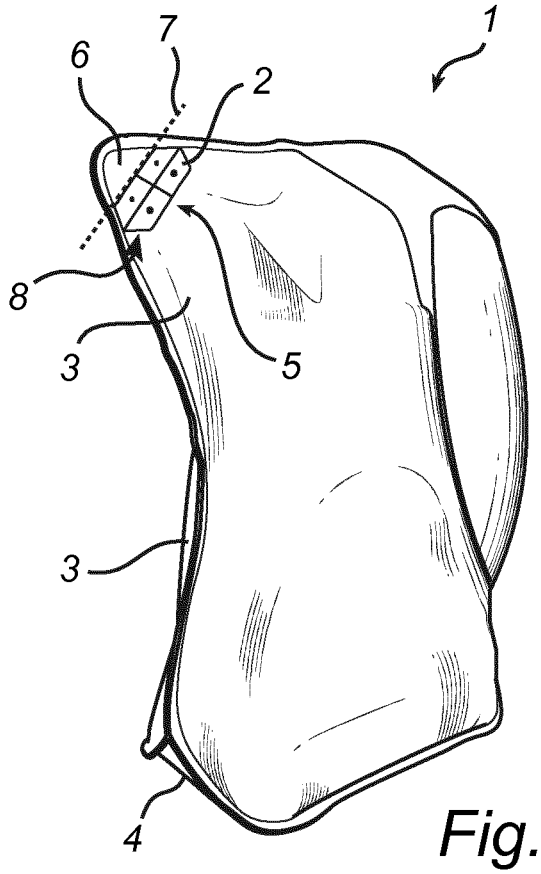
FIG. 1 shows a perspective view of a flexible package provided with an opening device of the thin-walled type.

A flexible package 1 provided with such an opening device 2 in the form of a thin-walled body is shown in FIG. 1 to which reference now is made.

The flexible package 1 is of the stand-up pouch type and comprises two side walls 3 and a bottom wall 4. The package may, as shown in the figure, comprise a gas filled handle.

The opening device 2 is applied to the package 1 in an opening portion 5 of the package 1, which opening portion 5 is formed by the two opposing side walls 3 of the flexible package 1 in an upper corner section of the same.

The opening portion 5 of the flexible package 1 comprises in the unopened state of the package 1 an end tab 6, which for initial opening of the package 1 is separable from the package 1 by detachment along a separation line 7. The package 1 is shown in its unopened state in FIG. 1.

The opening device 2 is disposed on an application area 8 in said opening portion 5 on one of the said opposing side walls 3 adjacent to the end tab 6, and, more precisely, is disposed on that side of the separation line 7 situated opposite the end tab 6, adjacent to and parallel with this same separation line 7.

After initial opening of the package 1 by removal of the end tab 6, the package 1 may be opened and closed by means of the opening device 2.

Figure 2A:
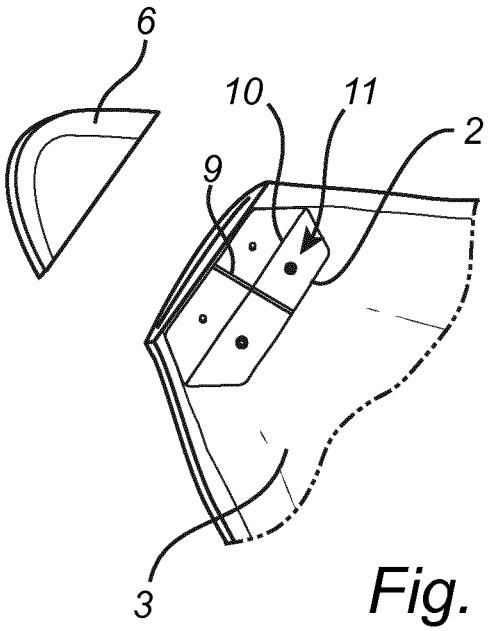
FIG. 2*a* shows a perspective part view of an opening portion of the package shown in FIG. 1 after initial opening thereof.
Figure 2B:
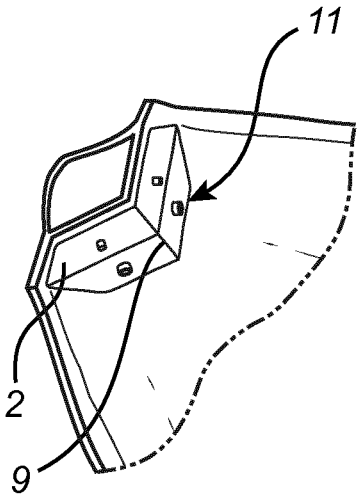
FIG. 2*b* shows a perspective part view of the opening portion of the package shown in FIG. 1 with the opening device in an opened-up position.
Figure 2C:
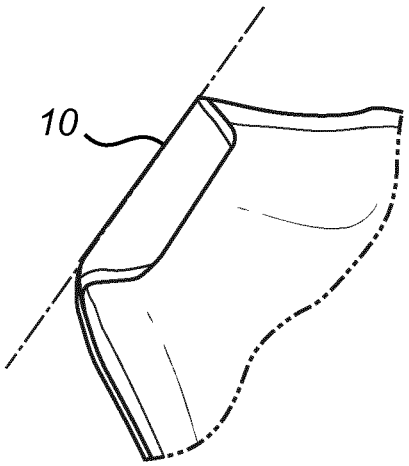
FIG. 2*c* shows a perspective part view of the opening portion of the package shown in FIG. 1 with the opening device in a resealed position.

In FIG. 2*a*, removal of the end tab 6 is disclosed, and in FIGS. 2*b* and 2*c*, opening and closing, respectively, of the package 1 is shown. More precisely, in order to open the package 1, the opening device 2 is folded about a transverse hinge joint 9; and in order to close or reseal the package, the opening device 2 is folded about a longitudinal hinge joint 10 and locked in the folded position by means of a locking means 11.

Figure 3:
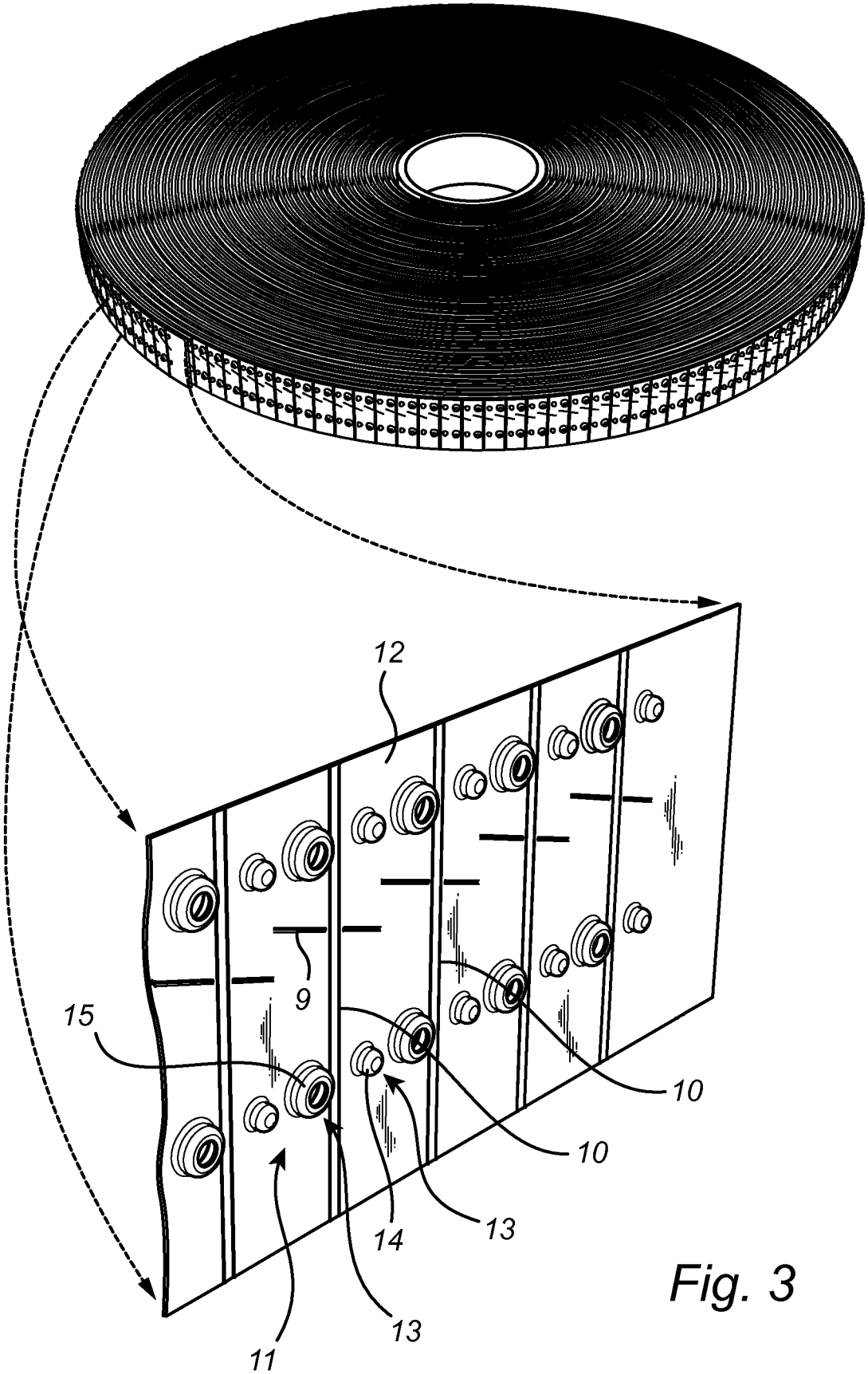
FIG. 3 shows a perspective view of a web of semi-finished and interconnected opening devices.

According to the invention, the opening devices to be attached on the flexible packages are provided by means of a web of semi-finished and interconnected opening devices, and such a web 12 is disclosed in FIG. 3.

The web 12 has been provided with a succession of transverse and longitudinal hinge joints 9 and 10, respectively, as well as locking means 11. In the shown embodiment, a single semi-finished opening device comprises a longitudinal hinge joint 10 and a transverse hinge joint 9 crossing said longitudinal hinge joint 10; and a locking means 11 comprising protrusions 13 forming two pairs of a male and female member 14 and 15, respectively, such that a male member 14 will engage a female member 15 by folding about the longitudinal hinge joint 10.

The opening device may be attached to the flexible package by means of a welding operation or by means of an adhesive.

The adhesive may be applied to the opening device and/or the application area of the package just prior to the application of the opening device. Alternatively, the opening device may be provided with an activable adhesive arranged on an application surface thereof. The adhesive may of the kind which is non-sticky in a non-activated state. The adhesive may be activable by means of heating.

Figure 4:
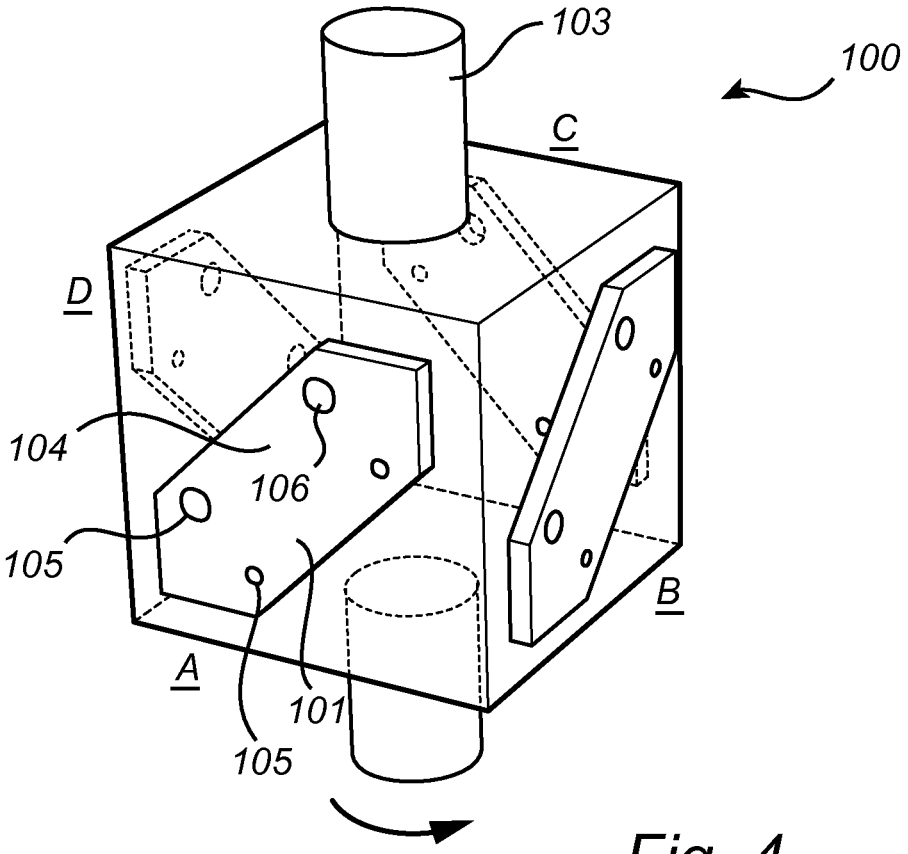
FIG. 4 shows a schematic perspective view of an attachment unit of a device for attachment of an opening device on a flexible package in accordance with the invention.

In FIG. 4, to which reference now is made, an attachment unit 100 for an inventive device for attaching a resealable opening device 2 on a flexible package 1 is schematically shown.

The attachment unit 100 comprises a carrier member 101 supported by a supporting structure. Thus, in the figure, a single carrier member 101 has been depicted in four different positions. It is of course possible for the supporting structure of the attachment unit to support more than one carrier member, such as two carrier members. In such a case, the carrier members may be arranged at opposing sides of the supporting structure. Alternatively, the supporting structure may support one carrier member along each side, i.e. four carrier members in total.

The attachment unit 100 is rotatably arranged about an axis 103 such that the carrier member 101 may be indexed between the different positions.

The different positions comprises a first position A corresponding to a pick-up position; a second position B corresponding to a heating position; a third position C corresponding to a attachment position; and a fourth position D corresponding to an idle position.

The carrier member 101 has a carrier surface 104 and in the shown embodiment, the carrier surface 104 is provided with recesses 105 arranged for reception of protrusions 13 of the opening device 2 forming the locking means 11.

The carrier means 101 further comprises a retention means indicated at 106 and arranged to hold the opening device 2 being picked up. The retention means 106 may, as indicated in the figure, be provided in at least one of the recesses 105 formed in the carrier surface 104 of the carrier member 101.

The operation of the attachment unit 1 of the inventive device will now be described with reference to FIGS. 5*a*-5*c*.

Figure 5A:
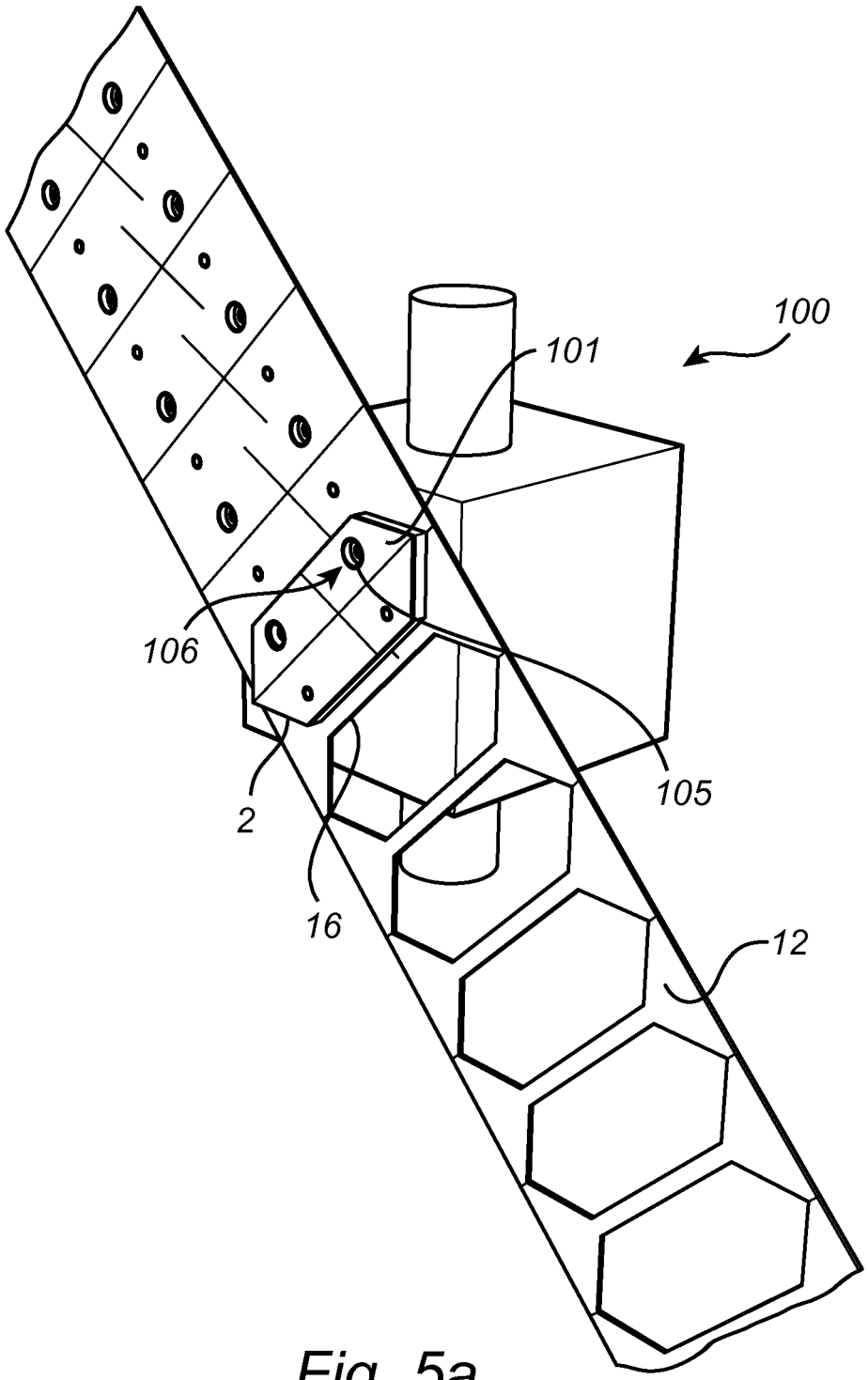
FIGS. 5*a*-5*c* show schematic perspective views of the inventive device for attachment of an opening device on a flexible package during operation.

In FIG. 5*a*, the carrier member of the attachment unit 100 is arranged in position A, i.e. the pick-up position.

A web 12 of semi-finished and interconnected opening devices is fed by a not shown feeding device to the pick-up position with an inclined orientation in order to align one semi-finished opening device to be picked up with the carrier member 101.

In the pick-up position, the carrier member 101 is moved by means of a relative movement towards an abutment (not shown) for engagement with the web 12 arranged therebetween in order to pick up the opening device 2. The carrier member 101 may be movable towards the abutment and/or the abutment may be movable towards the carrier member 101 in order to cause said engagement with the web 12.

The inventive device further comprises a knife arrangement (not shown) for cooperation with the carrier member 101 and the abutment for cutting out the opening device 2 from the web 12. The opening device 2 may thus be cut out by a punch engagement. As evident from the figure, the opening devices are punched out from the web 12 such that the web 12 is provided with a succession of holes 16. Thus, the integrity of the web 12 is maintained which facilitates the recovery of surplus material. In the drawing, the carrier member 101 is depicted as having been pressed through the web 12 in order to clearly illustrate the disengaging of the opening device 2 from the web 12.

It is understood that alternative methods exist for the forming of the opening devices while they are picked up by means of the carrier member. For instance, the opening devices may be pulled from the web along pre-made perforations outlining the opening devices.

The carrier means 101 further comprises a retention means indicated at 106 and arranged to hold the opening device 2 being picked up. The retention means 106 may as indicated in the figure be provided in at least one of the recesses 105 formed in the carrier surface 104 of the carrier member 101.

Figure 5B:
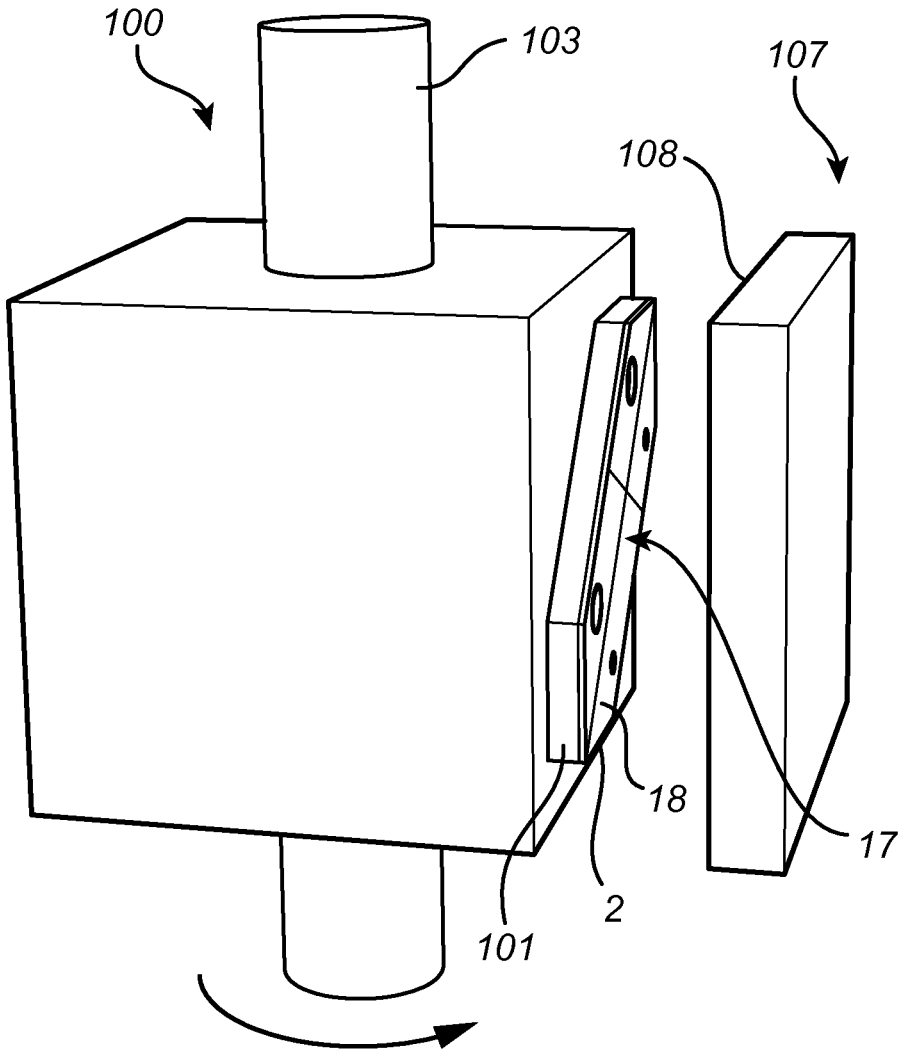

In FIG. 5*b*, the carrier member 101 has been moved to position B, i.e. the heating position, by means of rotating the attachment unit 100 about the axis 103.

In the heating position, the carrier member 101 and the opening device 2 supported thereof is positioned in front of a first heating unit 107 which in the shown embodiment forms part of the inventive device. In the shown embodiment, the opening device 2 is provided with an adhesive layer 17 on its application surface 18, and the first heating unit 107 is arranged for activation of said adhesive layer 17 by means of contact heating.

To this end, the first heating 107 unit comprises a engagement surface 108 arranged to engage or abut the adhesive layer 17 of the opening device 2 by means of relative movement between the carrier member 101 and the first heating unit 107.

The engagement surface 108 of the first heating unit 107 may be heated by means of one or more electrical heating element arranged in ducts provided in the body of the first heating unit 107.

The engagement surface may be replaceable arranged. For instance, the engagement surface 108 may be provided on a section of the first heating unit which is separate from the body of the first heating unit. Upon activation of the adhesive layer of the opening device, the body is pressed against the section comprising the engagement surface, which in turn is pressed against the adhesive layer. The provision of the engagement surface on a section separate from the body of the first heating unit enables easy maintenance or exchange of the engagement surface.

The first heating 107 unit ensures controlled heat transfer to the adhesive layer 17 and the engagement surface 108 may be provided with a surface treatment in order to prevent the adhesive layer 17 from adhering to said engagement surface 108.

The engagement surface 108 may be planar or may be provided with a profile, such as an undulated or wave shaped surface.

By using a profiled engagement surface 108, such as an undulated surface, it will be possible to reshape an initially planar adhesive layer 17 into a profiled adhesive layer 17 corresponding to the profile of the engagement surface 108. Hereby the capacity of the adhesive layer 17 to accumulate heat in its activated state may be improved and it may thus be ensured that the adhesive layer 17 is still active in connection with application of the opening device 2 on the flexible package 1.

Figure 5C:
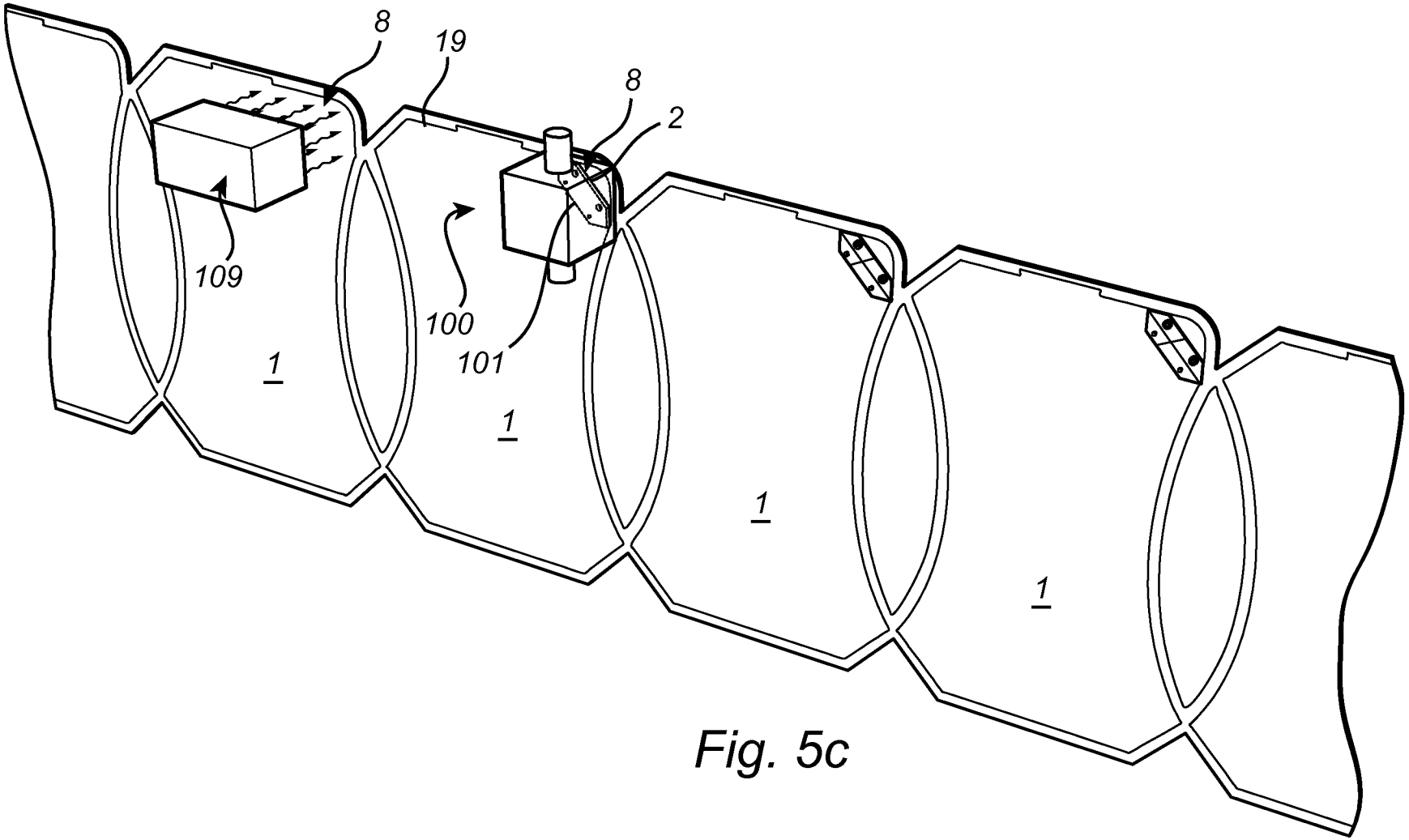

In FIG. 5*c*, the carrier member 101 is moved to position C, i.e. the attachment position, by means of continued rotation of the attachment unit 100 about the axis 103.

As evident from the figure, a web 19 of interconnected packages 1 is provided, and the opening device 2 supported by the carrier member 101 is, in the attachment position, positioned in front of one flexible package 1 on which an opening device 2 is about to be applied. More specifically, the web 19 of packages 1 is fed to the attachment position such that the application area 8 of the package 1 about to be provided with an opening device 2 is aligned with the carrier member 101.

In order to ensure an improved reliability of the application of the opening device 2 on the flexible package 1, the inventive device may as in the shown embodiment further comprise a second heating unit 109.

The second heating unit 109 is arranged for preheating of the application area 8 of the package 1. In the shown embodiment, the second heating unit 109 is arranged upstream of the attachment unit 100, such that while one flexible package 1 is being preheated, a subsequent flexible package 1 in the down-stream direction is being provided with an opening device 2.

By preheating of said application area 8, a difference in temperature between the adhesive layer 17 and the application area 8 may, in connection with the attachment of the opening device 2 on the package 1, be reduced. The reduced difference in temperature may improve the attachment of the opening device on the package.

The second heating unit 109 may comprise heating elements arranged for preheating by means of radiation. Alternatively, the second heating unit may be arranged to preheat the application area 8 by means of contact heating.

The carrier member 101 is arranged to attach the opening device 2 supported thereof on the application area 8 of the flexible package 1 by means of relative movement between the carrier member 101 and the flexible package 1. Once the opening device 2 has been pressed against the flexible package 1, the retention means 106 is operated to release the opening device 2, and subsequently the carrier member 2 and the flexible package 1 are separated, leaving the opening device 2 behind and attached to the flexible package 1.

Subsequently, the carrier member 2 is indexed or moved from the attachment position back to the pick-up position in order to form and pick up the next opening device 2. The movement may be accomplished by continued rotation of the attachment unit 100 about the axis 103 such that the carrier member 2 passes position D, i.e. the idle position. Alternatively, the attachment unit 100 may be rotated in the opposite direction and the carrier member 101 thus being moved to the pick-up position by passing position C.

Hereafter, the operation of the inventive device will be explained more in detail with reference to FIGS. 6*a*-6*l* showing cross sectional views of the attachment unit 100 and the carrier member 101 supported thereof in different situations.

The carrier member 101 is supported by supporting structure 102 which in turn is rotatably arranged about the axis 103.

The carrier member 101 is further reciprocally movable in a direction perpendicular to the carrier surface 104 of the carrier member 101 by means of said supporting structure 102. The supporting structure 102 may be arranged to move of the carrier member 101 in any suitable manner such as by a pneumatically or electrically controlled mechanism (not shown).

The protrusions 13 forming the female members 15 of the locking means 11 of the opening device 2 are evident from the figures. More precisely, each female member 15 is formed by a protrusion 13 provided with an upper opening 20 adapted for reception of the male member 14 through a snap fit action when the opening device 2 is folded about the longitudinal hinge joint as previously described.

The figures further depict the retention means 106 for holding the picked up opening device 2.

In the shown embodiment, the retention means 106 is formed by a pin 110 movably arranged in each of the recesses 105 provided in the carrier surface 104 of the carrier member 101 for reception of the female members 15 of the locking means 11 of the opening device 2. More precisely, the pins 110 are movable from a first position corresponding to an idle position to a second position corresponding to a holding position. Each pin 110 is provided with an end cavity 111 arranged to receive an associated female member 15 with a tight fit when being moved to said second position.

FIGS. 6*a*-6*d* disclose the operation while the carrier member 101 is in position A, i.e. the pick-up position.

Figure 6B:
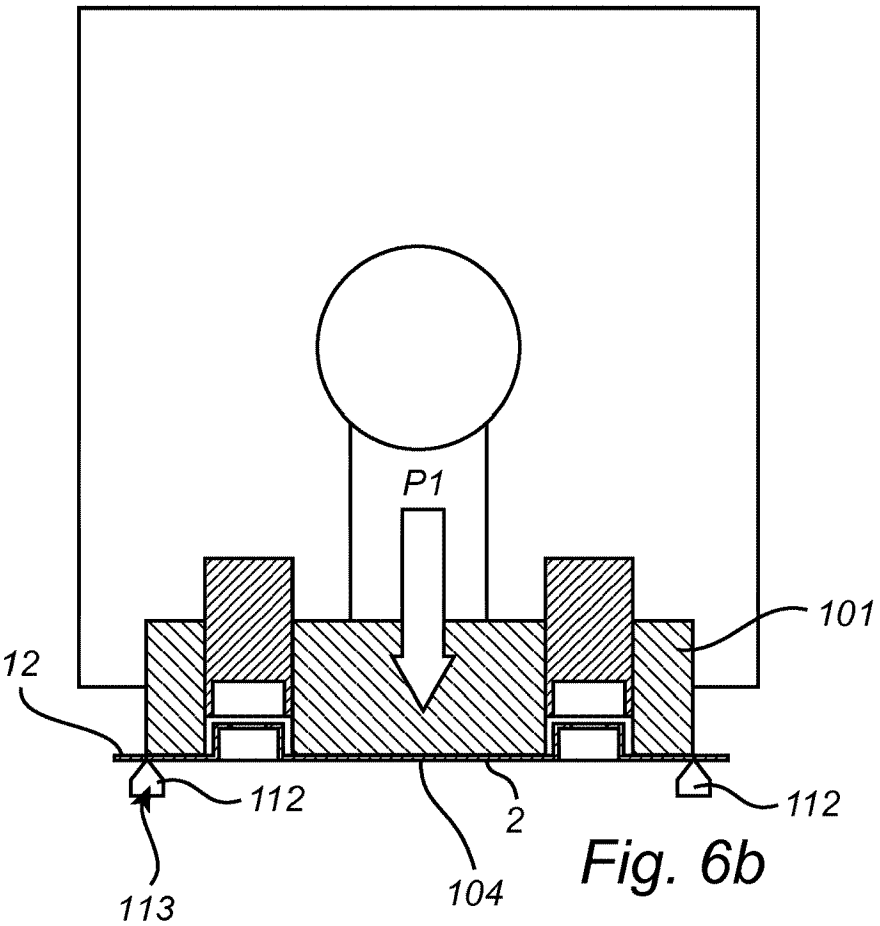
FIGS. 6*a*-6*l* show schematic cross sectional views of an embodiment of the inventive device during operation.
Figure 6A:
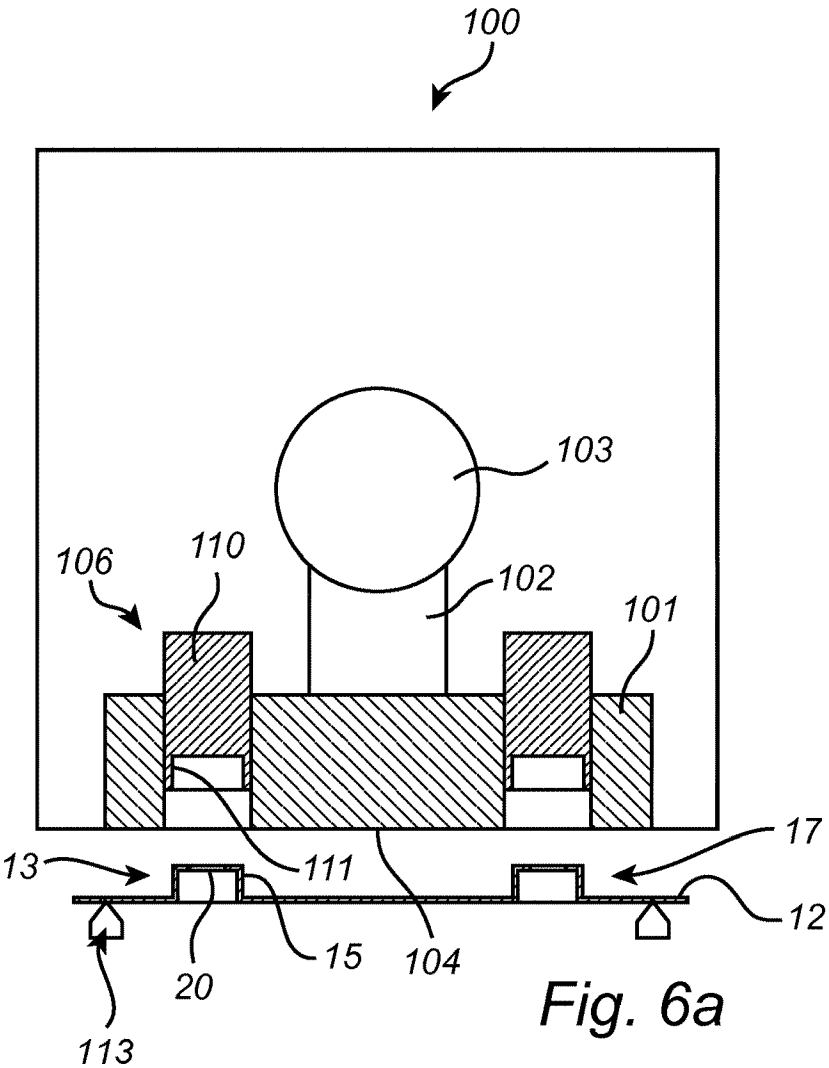

As shown in FIG. 6*a*, a semi-finished opening device 2, forming part of the web 12 of semi-finished and interconnected opening devices is arranged between the carrier member 101 and a knife arrangement 112. The opening device 2 is thus aligned in front of the carrier member 101 of the attachment unit 100 in said pick-up position.

In the shown embodiment, the knife arrangement 112 forms an abutment 113 against which the carrier member 101 is moved, the knife arrangement 112 thus being formed integral with the abutment 113. It is to be understood that there exists other ways of arranging the knife arrangement on the abutment and that the knife arrangement may be formed separately from the abutment.

The knife arrangement 112 may also be arranged on the carrier member.

In FIG. 6*b*, the carrier member 101 has been moved in the direction indicated by arrow P1 by the supporting structure 102 towards the abutment 113 and the web 12 arranged therebetween such that carrier surface 104 of the carrier member 101 presses against the knife arrangement 112 provided on the opposite side of the web 12. As a consequence, a punch engagement is accomplished for cutting out or outlining the opening device 2 in the web 12. Thus, the knife arrangement 112 cooperates with the carrier member 10 and the abutment 113 for cutting out the opening device 2 during the engagement of the carrier member 101 with the web 112.

Figure 6D:
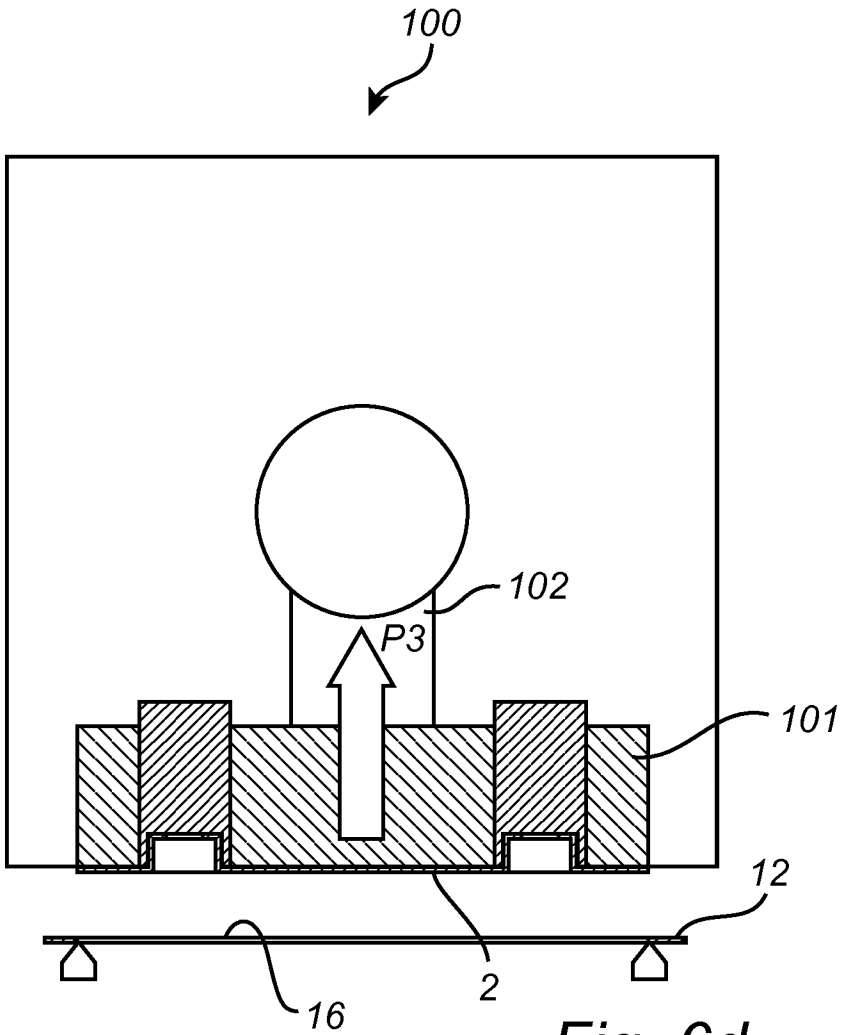
Figure 6C:
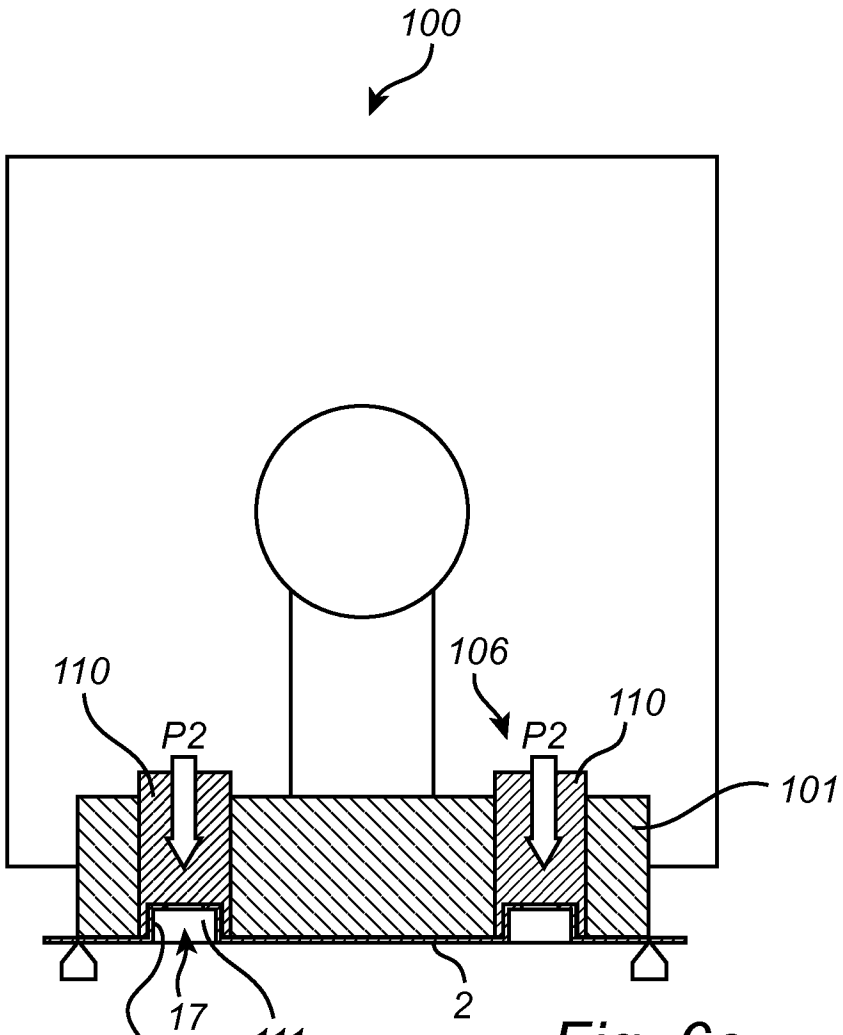

In FIG. 6*c*, the pins 110 of the retention means 106 have been moved in the direction indicated by arrows P2 from the first position, i.e. the idle position, to the second position, i.e. the holding position. As evident, the female members 15 of locking means 11 of the opening device 2 are each received by an associated end cavity 111 of the pins 110. As mentioned above, the end cavities 111 are arranged to receive the female members 15 with a tight fit, whereby a retention action is achieved ensuring that the opening device 2 is reliable secured to the carrier member 101.

The operation of the retention means 106 may by achieved by a pneumatic, hydraulic, electric, magnetic arrangement or the like.

In FIG. 6*d*, the carrier member 101 is retracted in the direction indicated by arrow P3 by means of the supporting structure 102, picking up the opening device 2 and leaving a hole 16 in the web 12 caused by the picked up opening means 2. However, the opening device 2 is punched out of the web 12 such that the integrity of the web 12 is maintained which facilitates the recovery of surplus material. For instance, the surplus may be wound up, and the resulting roll may by used as raw material for manufacturing of other products, such as new webs of semi-finished and interconnected opening devices.

Figure 6F:
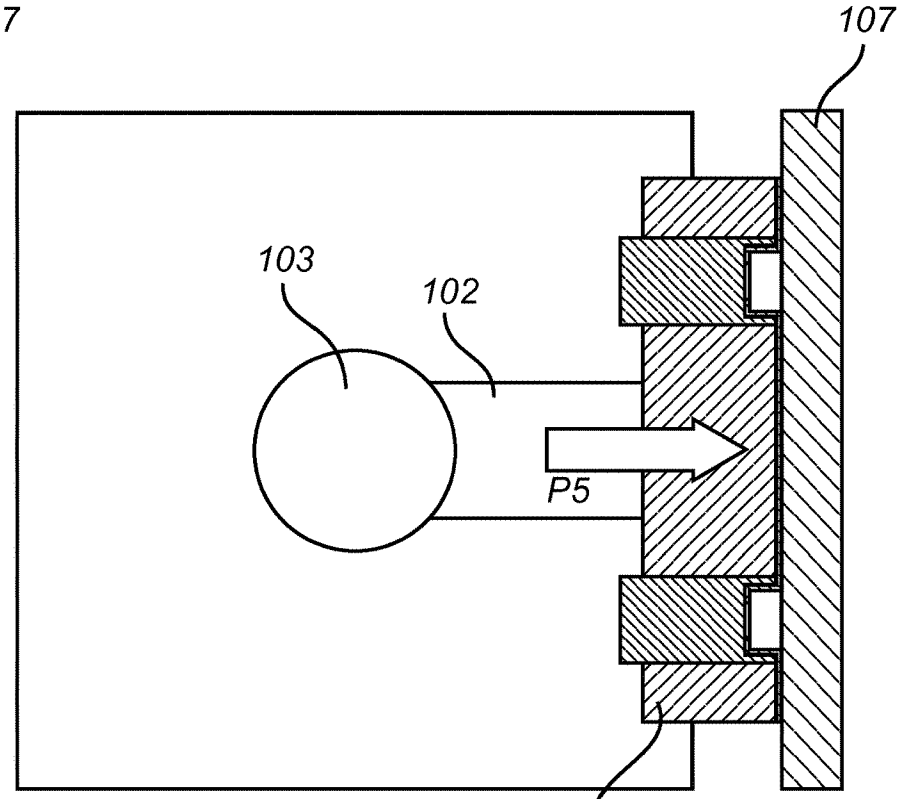
Figure 6E:
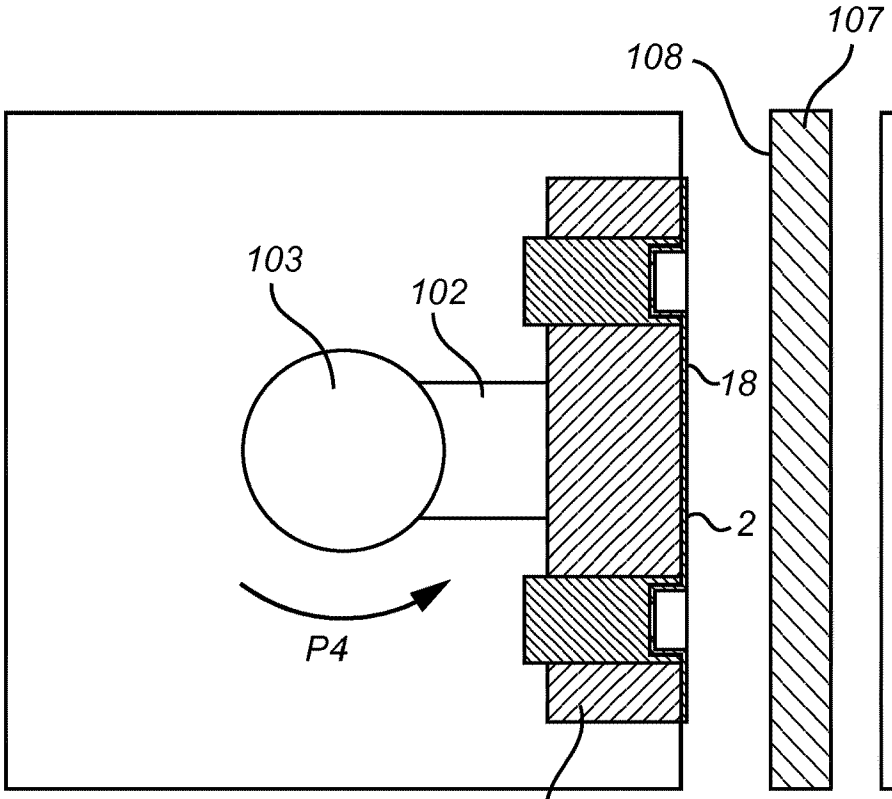
Figure 6H:
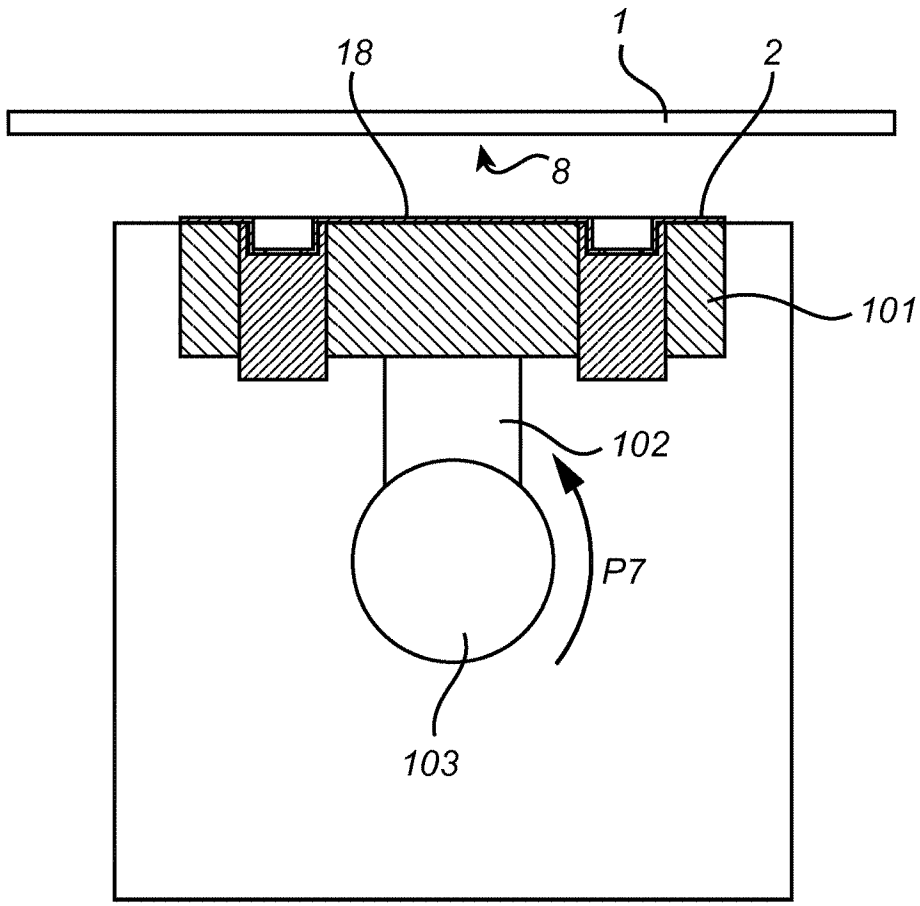
Figure 6G:
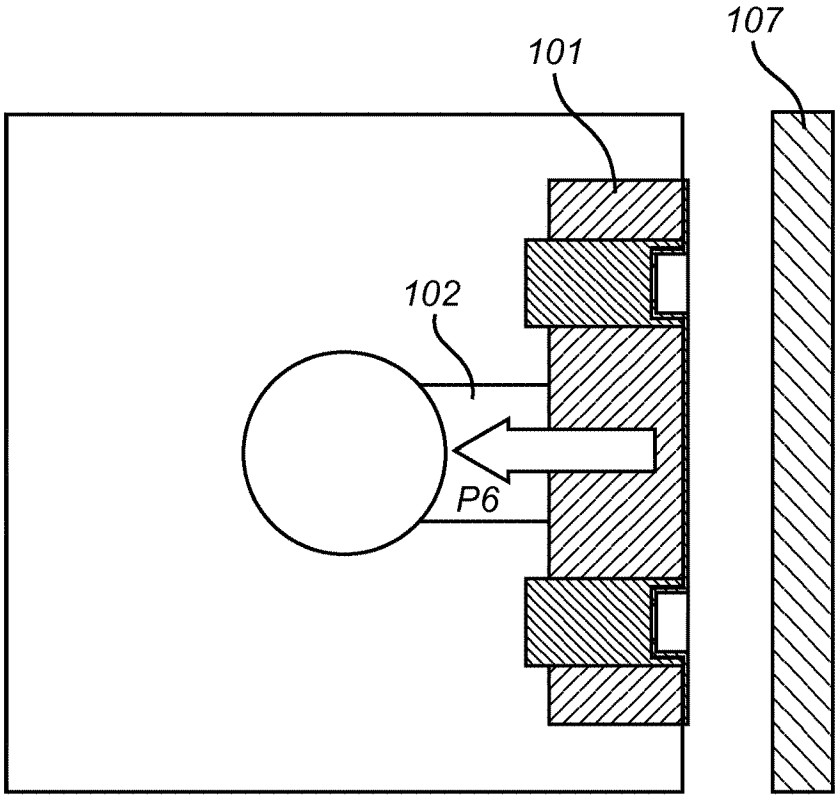

FIGS. 6*e*-6*g* disclose the operation while the carrier member 101 is in position B, i.e. the heating position.

FIG. 6*e* shows the carrier member 101 and the opening device 2 supported thereby moved to said heating position by rotation of the supporting structure 102 about the axis 103 in the direction indicated by arrow P4. In the heating position, the application surface 18 of the opening device 2 is positioned in front of the engagement surface 108 of the first heating unit 107.

In FIG. 6*f*, the carrier member 101 has been moved in the direction indicated by arrow P5 towards the first heating 107 unit by means of the supporting structure 102 such that the application surface 18 of the opening device 2 is pressed against the engagement surface 108, whereby the adhesive layer 17 applied on the application surface 18 of the opening device 2 is activated. The engagement surface 108 is planar in the shown embodiment, but as explained above, the engagement surface may be profiled in order to produce an activated adhesive layer with a profiled shape and improved capacity to accumulate heat.

In FIG. 6*g*, the carrier member 101 has been retracted in the direction indicted by arrow P6 from the first heating unit 107 by means of the supporting structure 102. The carrier member 101 may be hold stationary in the retracted position shown in FIG. 6*g* for a short period of time, such as 1-5 ms, in order to allow threads of adhesive, which may have been formed during the retraction of the carrier member 10, to sufficiently cool in order to break during subsequent movement of the carrier member 101.

FIGS. 6*h*-6*k* disclose the operation while the carrier member 101 is in position C, i.e. the attachment position.

FIG. 6*h* shows the carrier member 101 and the opening device 2 supported thereby moved to said application position by rotation about the axis 103 in the direction indicated by arrow P7. In the attachment position, the opening device 2 and its application surface 18 with activated adhesive layer 17 is positioned in front of the application area 8 of a flexible package 1. The application area 8 may, as previously has been described, be preheated. Also, the package 1 may be included in a web of interconnected packages.

Figure 6J:
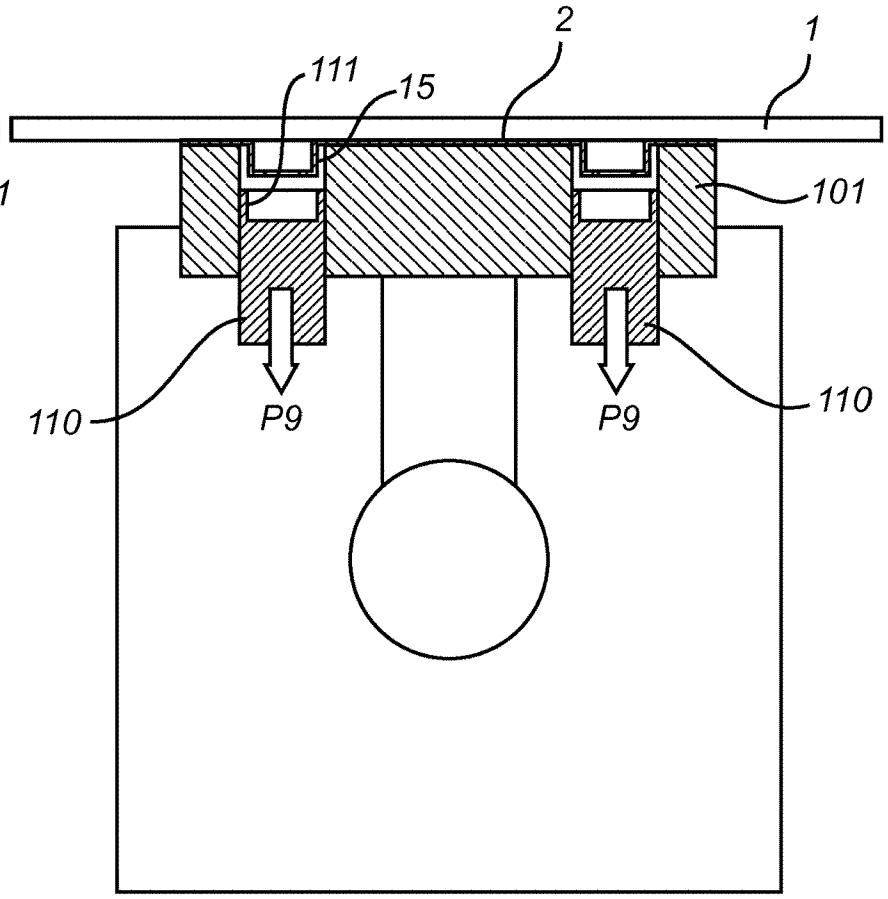
Figure 6I:
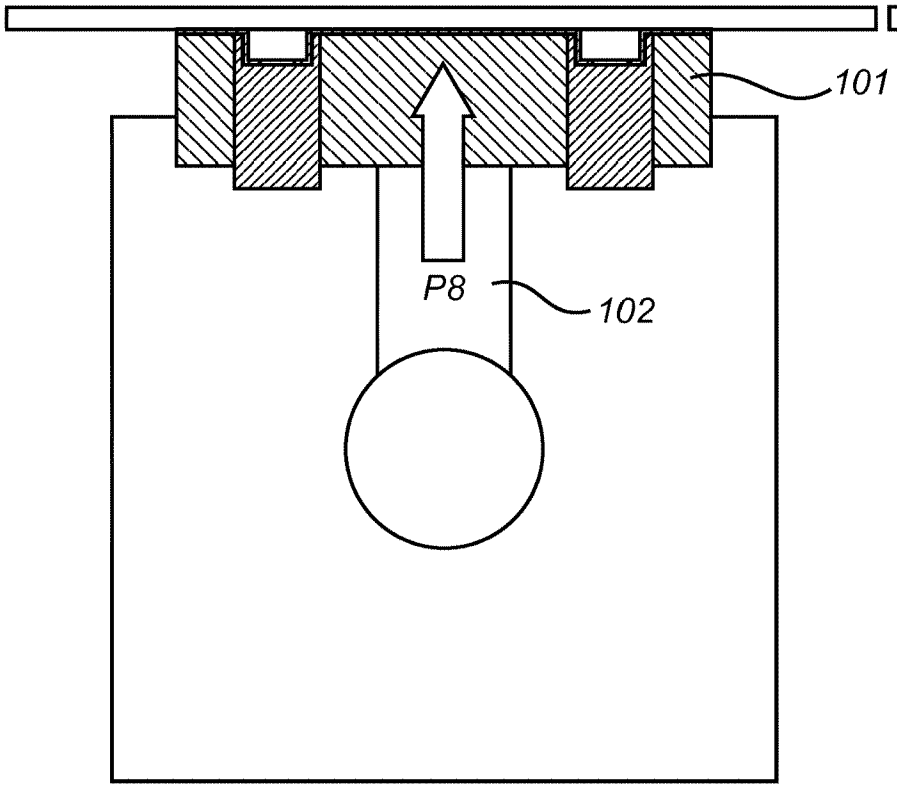

In FIG. 6*i*, the carrier member 101 has been moved towards the flexible package 1 by means of the supporting structure 102 and indicated by arrow P8 such that the application surface 18 of the opening device 2 is pressed against the application area 8 of the flexible package 1. Since the adhesive layer 17 on the application surface 18 has been activated in the previous position B, the opening device 2 will adhere to the application area 8 of the package. 1 Cooling, either forced or natural, will case the opening device 2 to be fixedly attached to the flexible package 1.

By moving the pins 110 back to the first position, as shown in FIG. 6*j* and indicated by arrows P9, while the carrier member 101 is being maintained against the flexible package 1, the end cavities 111 of the pins 110 will disengage the female members 15 of the opening device 2, that is, the female members 15 will be released from the tight fit grip by the end cavities 111 of the pins 110. Thus, by moving the pins 110 to the first position, the retention means 106 releases its hold of the opening device 2.

Figure 6L:
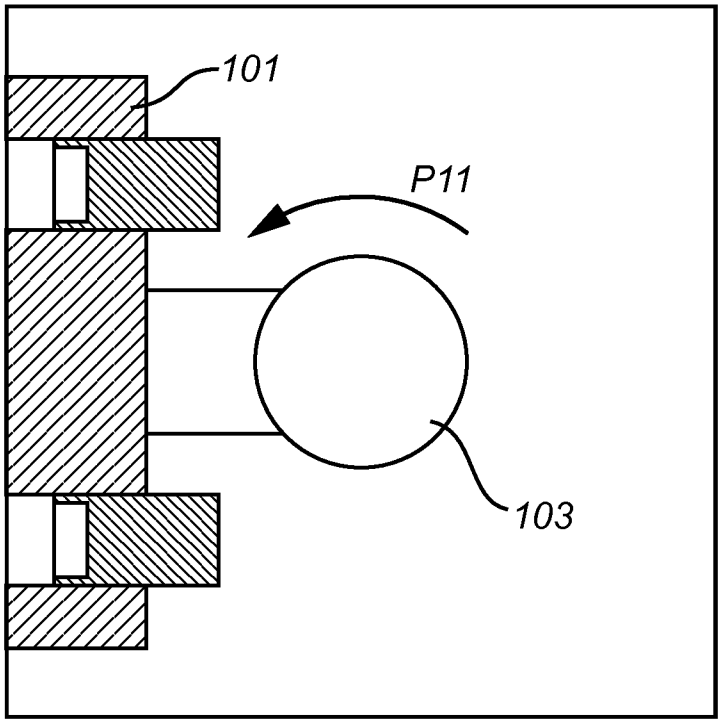
Figure 6K:
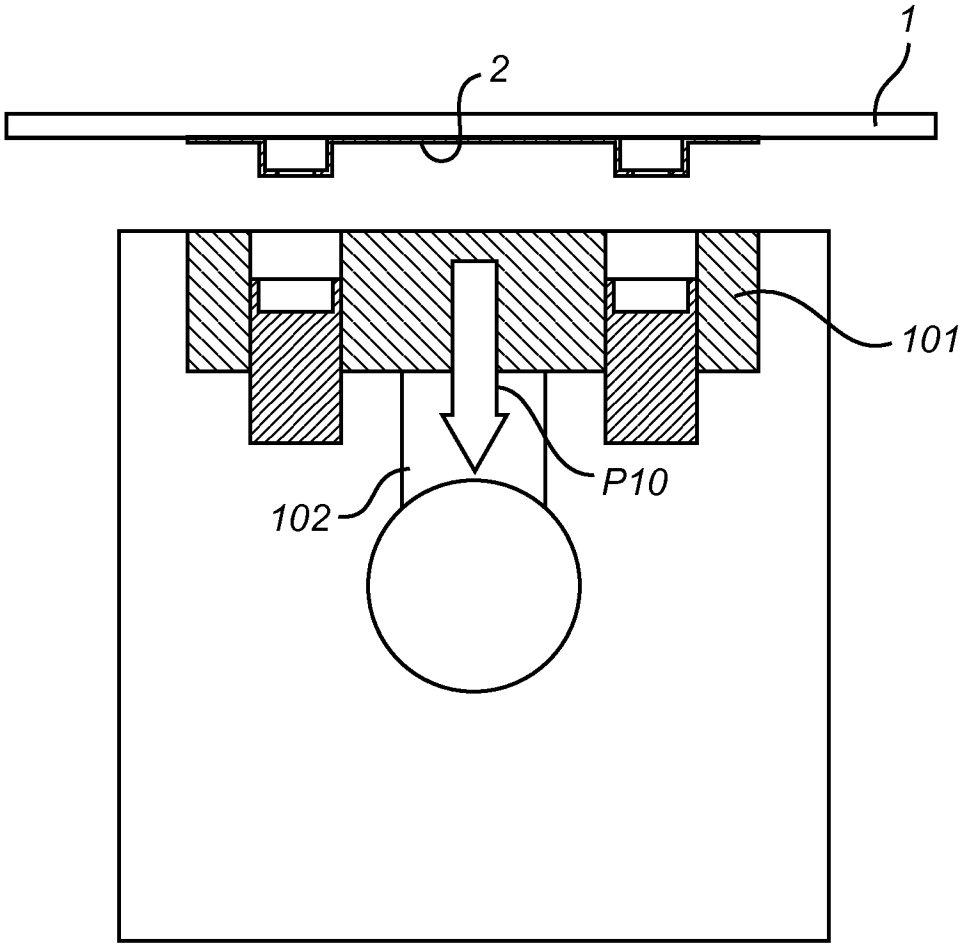

In FIG. 6*k*, the carrier member 101 has been retracted in the direction indicated by arrow P10 from the flexible package 1 by means of the supporting structure 102 while the opening device 2 remains attached to the flexible package 1.

FIG. 6*l* shows the carrier member 101 moved to position D, i.e. the idle position, by rotation about the axis 103 in the direction indicated by arrow P11.

By continued rotation about the axis 103, the carrier member 101 will be returned to position A, and the cycle of operation may be repeated for attachment of the next opening device on the next flexible package.

It will be appreciated that the present invention is not limited to the embodiments shown.

It is thus possible to replace the above described knife arrangement positioned on the abutment on the opposite side of the web of semi-finished and interconnected opening devices with a knife arrangement supported by the carrier member itself. In this case, the carrier member and its knife arrangement is pressed against the abutment with the web arranged therebetween in order to cut out a opening device by punch engagement.

Alternatively, the knife arrangement may be arranged on both the carrier member and the abutment, whereby knife edges of the knife arrangement may be pressed against each other for cutting out the opening device.

It is also possible to replace the first heating unit in the form of a contact-heater with a radiation-heater or hot-air heater.

Further, the opening devices may not comprise an adhesive layer. In such a case, the first heating unit may be replaced with a hot-melt applicator applying a hot-melt adhesive on the application area of the flexible package just prior to the attachment of the opening device.

As mentioned above, it is also possible for the attachment unit to comprise several carrier members operating simultaneous in different positions.

It is also possible for the inventive device to comprise several attachment units operating in parallel. For instance, the inventive device may comprise three attachment units arranged in parallel and cooperating for attaching opening devices on a single web on interconnected flexible packages.

The opening devices included in the web of semi-finished and interconnected opening device may be of other types than the thin-body type described above. For instance, the web may carry opening devices in the form of the screw cap type.

Several modifications and variations are thus conceivable within the scope of the invention which thus is exclusively defined by the appended claims.

The invention claimed is:

1. A device for attaching an opening device on a flexible package, the device comprising:

a knife arrangement;

an attachment unit having at least one rotatably arranged carrier member, the at least one carrier member being rotatable between a pick-up position, a heating position, and an attachment position, such that the at least one carrier member is configured to complete at least one full rotation, wherein, in said attachment position the at least one carrier member is arranged to attach to the opening device on an application area of the flexible package by relative movement between the carrier member and the flexible package; and an abutment, wherein the at least one carrier member, in said pick-up position, is arranged for relative movement towards the abutment for engagement with a web of semi-finished and interconnected opening devices arranged therebetween, wherein the knife arrangement is arranged on the carrier member or the abutment to punch out the opening device from the web and the carrier member is configured to pick up the punched out opening device that is separated from the web in response to the engagement of the carrier member with the web.

2. The device according to claim 1, wherein the knife arrangement is arranged on the abutment.

3. The device according to claim 1, wherein the knife arrangement is arranged on the carrier member.

4. The device according to claim 1, wherein the attachment unit is rotatably arranged, and the at least one carrier member is movable between said pick-up position and said attachment position by rotation of the attachment unit.

5. The device according to claim 1, further comprising a first heating unit provided at the heating position, wherein the at least one carrier member is arranged to pass the heating position during movement from said pick-up position to said attachment position, the first heating unit being arranged to activate an adhesive layer of the opening device by heating.

6. The device according to claim 5, wherein the first heating unit comprises an engagement surface arranged to activate said adhesive layer by contact heating.

7. The device according to claim 6, wherein the engagement surface is profiled.

8. The device according to claim 5, further comprising a second heating unit configured to preheat the application area of the flexible package.

9. The device according to claim 8, wherein the second heating unit is arranged to preheat the application area by radiation.

10. The device according to claim 1, wherein the at least one carrier member comprises a carrier surface provided with a recess arranged to receive a protrusion of the opening device.

11. The device according to claim 10, further comprising a pin arranged in said recess, the pin being configured to move between a first position and a second position in order to engage the protrusion received into the recess.

12. The device according to claim 1, wherein the knife arrangement is arranged to be on a first side of the web and the carrier member is arranged to be on a second side of the web.

13. A method for attaching an opening device on a flexible package, the method comprising:

providing a web of semi-finished and interconnected opening devices;

punching out and picking up the opening device via a rotatable carrier member of an attachment unit towards an abutment to engage the web of semi-finished and interconnected opening devices arranged therebetween, wherein the carrier member being rotatable between a pick-up position, a heating position, and an attachment position such that the carrier member is configured to complete at least one full rotation, wherein a knife arrangement is arranged on the carrier member or the abutment to punch out the opening device from the web such that the carrier member picks up the punched out opening device that is separated from the web in response to engaging of the carrier member with the web; and attaching the punched out opening device on an application area of the flexible package.

14. The method according to claim 13, further comprising activation of an adhesive layer of the opening device by contact heating prior to attaching the opening device to the flexible package.

15. The method according to claim 14, wherein the activation of the adhesive layer comprises engaging said adhesive layer with a profiled engagement surface of a first heating unit.

16. The method according to claim 13, further comprising preheating of said application area of the flexible package prior to the attaching of the opening device.

17. The method according to claim 13, wherein the knife arrangement is arranged to be on a first side of the web and the carrier member is arranged to be on a second side of the web.

* * * * *